US010513757B2

(12) United States Patent
Li et al.

(10) Patent No.: US 10,513,757 B2
(45) Date of Patent: Dec. 24, 2019

(54) CORROSION-RESISTANT, HIGH-HARDNESS ALLOY COMPOSITION AND METHOD FOR PRODUCING SAME

(71) Applicants: TOHOKU UNIVERSITY, Sendai-shi, Miyagi (JP); KABUSHIKA KAISHA EIWA, Kamaishi-shi, Iwate (JP)

(72) Inventors: Yunping Li, Sendai (JP); Akihiko Chiba, Sendai (JP)

(73) Assignees: TOHOKU UNIVERSITY, Miyagi (JP); KABUSHIKA KAISHA EIWA, Iwate (JP)

( * ) Notice: Subject to any disclaimer, the term of this patent is extended or adjusted under 35 U.S.C. 154(b) by 513 days.

(21) Appl. No.: 15/500,653

(22) PCT Filed: Aug. 5, 2014

(86) PCT No.: PCT/JP2014/070621

§ 371 (c)(1),
(2) Date: Jan. 31, 2017

(87) PCT Pub. No.: WO2016/020985

PCT Pub. Date: Feb. 11, 2016

(65) Prior Publication Data

US 2017/0218484 A1 Aug. 3, 2017

(51) Int. Cl.

| | |
|---|---|
| ***C22C 19/05*** | (2006.01) |
| ***C22F 1/10*** | (2006.01) |
| ***C22F 1/00*** | (2006.01) |

(52) U.S. Cl.

CPC ..... *C22C 19/056* (2013.01); *C22C 19/05* (2013.01); *C22F 1/10* (2013.01); *C22F 1/00* (2013.01)

(58) Field of Classification Search

CPC ..... C22C 19/056; C22C 19/05; C22F 1/10; C22F 1/00

See application file for complete search history.

(56) References Cited

U.S. PATENT DOCUMENTS

| | | | |
|---|---|---|---|
| 2007/0181225 A1 | 8/2007 | Igarashi et al. | |
| 2013/0156628 A1* | 6/2013 | Forbes Jones | C22C 38/42 420/38 |

FOREIGN PATENT DOCUMENTS

| | | | |
|---|---|---|---|
| EP | 1433864 | A2 | 6/2004 |
| EP | 1777313 | A1 | 4/2007 |
| JP | S57-210941 | A | 12/1982 |
| JP | S62-260033 | A | 11/1987 |
| JP | H01-272738 | A | 10/1989 |
| JP | H06-57360 | A | 3/1994 |
| JP | H06-200343 | A | 7/1994 |
| JP | 2010-001558 | A | 1/2010 |
| WO | 2006/003954 | A1 | 1/2006 |

OTHER PUBLICATIONS

Dec. 18, 2017 Office Action issued in Chinese Patent Application No. 201480081096.7.

Jun. 13, 2017 Extended Search Report issued in European Patent Application No. 14899105.2.

Nov. 8, 2014 International Search Report issued in International Patent Application No. PCT/JP2014/070621.

Yunping et al., "Effects of partially substituting cobalt for nickel on the corrosion resistance of a Ni-16Cr-15Mo alloy to aqueous hydrofluoric acid;" Corrsion Science; vol. 78; Jan. 2014; pp. 101-110.

* cited by examiner

*Primary Examiner* — Daniel C. McCracken
(74) *Attorney, Agent, or Firm* — Oliff PLC

(57) ABSTRACT

Provided is a corrosion-resistant, high-hardness alloy composition, which realizes both corrosion resistance and high hardness by using a Ni—Co—Cr—Mo-based alloy and optimizing the chemical composition, heat treatment conditions and processing conditions thereof, and a method for producing that alloy composition. The alloy composition is an alloy composition comprising 15.5% by weight to 16.5% by weight of Cr, 7.5% by weight to 15.5% by weight of Mo, 0% by weight to 30% by weight of Co, 4.5% by weight to 15% by weight of Fe and 0.5% by weight to 4.0% by weight of Cu, with the remainder consisting of Ni and unavoidably included elements, wherein the crystal phase consists only of a γ phase and the Vickers hardness at room temperature is 500 HV or more. The alloy composition is obtained by subjecting an ingot of an alloy having the aforementioned composition to homogenization treatment for 4 hours to 24 hours at 1100° C. to 1300° C., followed by subjecting to cold processing at a compression rate of 30% to 60% and then to aging treatment for 0.5 hours to 3 hours over a temperature range of 300° C. to 600° C.

2 Claims, 3 Drawing Sheets

CORROSION-RESISTANT, HIGH-HARDNESS ALLOY COMPOSITION AND METHOD FOR PRODUCING SAME

FIELD OF THE INVENTION

The present invention relates to a corrosion-resistant, high-hardness alloy composition, which demonstrates a high degree of corrosion resistance to hydrofluoric acid, has higher hardness (wear resistance) in comparison with conventional Ni-based alloy materials, and is preferable for use as a resin molding screw or cylinder for fluorine-containing resins, and to a method for producing the same.

DESCRIPTION OF THE RELATED ART

Ni—Cr—Mo-based alloys having superior hydrofluoric acid corrosion resistance have typically been used in the past as members such as screws or cylinders of resin molding used to mold fluorine-containing resins such as perfluoroalkoxyalkanes (PFA), polytetrafluoroethylene (PTFE), ethylene-tetrafluoroethylene copolymers (ETFE) or polyvinylidene fluoride (PVDF). However, since conventional Ni-based mold materials having superior corrosion resistance have low alloy hardness, they have the shortcoming of low wear resistance. Members such as the screw or cylinder of resin molding machines are required to have wear resistance to contact with fluorine-containing resin fluid pumped in at high pressure and high speed. When components made of conventional materials are used for an extended period of time, screw and cylinder components undergo dimensional changes caused by wear, thereby causing a decrease in the amount of resin flowing therein.

A Co-based alloy, which has corrosion resistance and wear resistance, comprising 5% to 20% of Cr, 5% to 20% of Mo, 5% to 15% of W, 0.5% to 4% of B, 0.5% to 3% of Si and 1.5% or less of C, with the remainder consisting of Co, has been disclosed as a measure for improving wear resistance (see, for example, Patent Document 1). The main component of this alloy in the form of Co is a rare metal that is also a strategic material, making it expensive while also being susceptible to an unstable supply.

In addition, an alloy comprising 5% to 20% of Cr, 7% to 30% of Mo, 0.5% to 30% of one type or two types of W and V, 0.1% to 6% of B, 0.5% to 3% of Si and 1.5% or less of C, with the remainder consisting substantially of Ni, has been proposed in order to decrease the disadvantageous cost of Co materials (see, for example, Patent Document 2). Although this alloy is a material that realizes both corrosion resistance and wear resistance by imparting a chemical composition containing 0.5% to 15% of Co and/or 2% to 10% of Fe for the purpose of improving tenacity, it cannot be expected to demonstrate a significant increase in wear resistance due to the small increase in material hardness.

In addition, a Ni-based alloy having corrosion resistance to hydrofluoric acid has been disclosed for use as an alloy demonstrating a high degree of corrosion resistance to hydrofluoric acid that contains 16% of Cr, 15% of Mo, 6% of Fe and 4% of W with the remainder consisting of Ni (see, for example, Non-Patent Document 1). Here, in the case of not carrying out processing (homogenization treatment state) on an alloy in which Ni has been substituted with 15% by weight to 30% by weight of Co for the purpose of improving wear resistance, although wear resistance (hardness) can be improved without causing deterioration of corrosion resistance, corrosion resistance to hydrofluoric acid decreases considerably when material hardness is attempted to be further improved by cold processing.

PRIOR ART DOCUMENTS

Patent Documents

[Patent Document 1] Japanese Unexamined Patent Application Publication No. H1-272738

[Patent Document 2] Japanese Unexamined Patent Application Publication No. H6-57360

Non-Patent Documents

[Non-Patent Document 1] Yunping Li, Xiuru Fan, Ning Tang, Huakang Bian, Yuhang Hou, Yuichiro Koizumi, Akihiko Chiba, "Effects of partially substituting cobalt for nickel on the corrosion resistance of a Ni-16Cr-15Mo alloy to aqueous hydrofluoric acid", Corrosion Science, 2014, Vol. 78, p. 101-110

SUMMARY OF THE INVENTION

Problems to be Solved by the Invention

Therefore, an object of the present invention is to provide a corrosion-resistant, high-hardness alloy composition by using a Ni—Co—Cr—Mo—Fe—Cu-based alloy, which although is somewhat higher in terms of raw material costs than conventionally used Ni—Cr—Mo—Fe—W-based alloys, realizes both corrosion resistance and high hardness by optimizing the chemical composition, heat treatment conditions and processing conditions thereof, and to provide a method for producing the same.

Means for Solving the Problems

According to the present invention, a corrosion-resistant, high-hardness alloy composition is obtained comprising 15.5% by weight to 16.5% by weight of Cr, 7.5% by weight to 15.5% by weight of Mo, 0% by weight to 30% by weight of Co, 4.5% by weight to 15% by weight of Fe and 0.5% by weight to 4.0% by weight of Cu, with the remainder consisting of Ni and unavoidably included elements, wherein the crystal phase consists only of a γ phase and the Vickers hardness at room temperature is 500 HV or more.

In addition, according to the present invention, a method is provided for producing a corrosion-resistant, high-hardness alloy composition comprising subjecting an ingot of an alloy, comprising 15.5% by weight to 16.5% by weight of Cr, 7.5% by weight to 15.5% by weight of Mo, 0% by weight to 30% by weight of Co, 4.5% by weight to 15% by weight of Fe and 0.5% by weight to 4.0% by weight of Cu, with the remainder consisting of Ni and unavoidably included elements, to homogenization treatment for 4 hours to 24 hours at 1100° C. to 1300° C., followed by subjecting to cold processing at a compression rate of 30% to 60% and then to aging treatment for 0.5 hours to 3 hours over a temperature range of 300° C. to 600° C.

Effects of the Invention

According to the present invention, a corrosion-resistant, high-hardness alloy composition, which realizes both corrosion resistance and wear resistance by adding Cu and optimizing the chemical composition, heat treatment conditions and processing conditions thereof in order to improve deterioration of the corrosion resistance of Ni—Co—Cr—Mo—Fe-based alloys caused by processing, and a method for producing that alloy composition, can be provided. As a result, members such as the screw or cylinder used for resin molding of fluorine-containing resins and the like can be operated for a long period of time while also making it possible to contribute to cost reductions of plastic resin molded articles.

DESCRIPTION OF THE PREFERRED EMBODIMENTS

Figure 1:
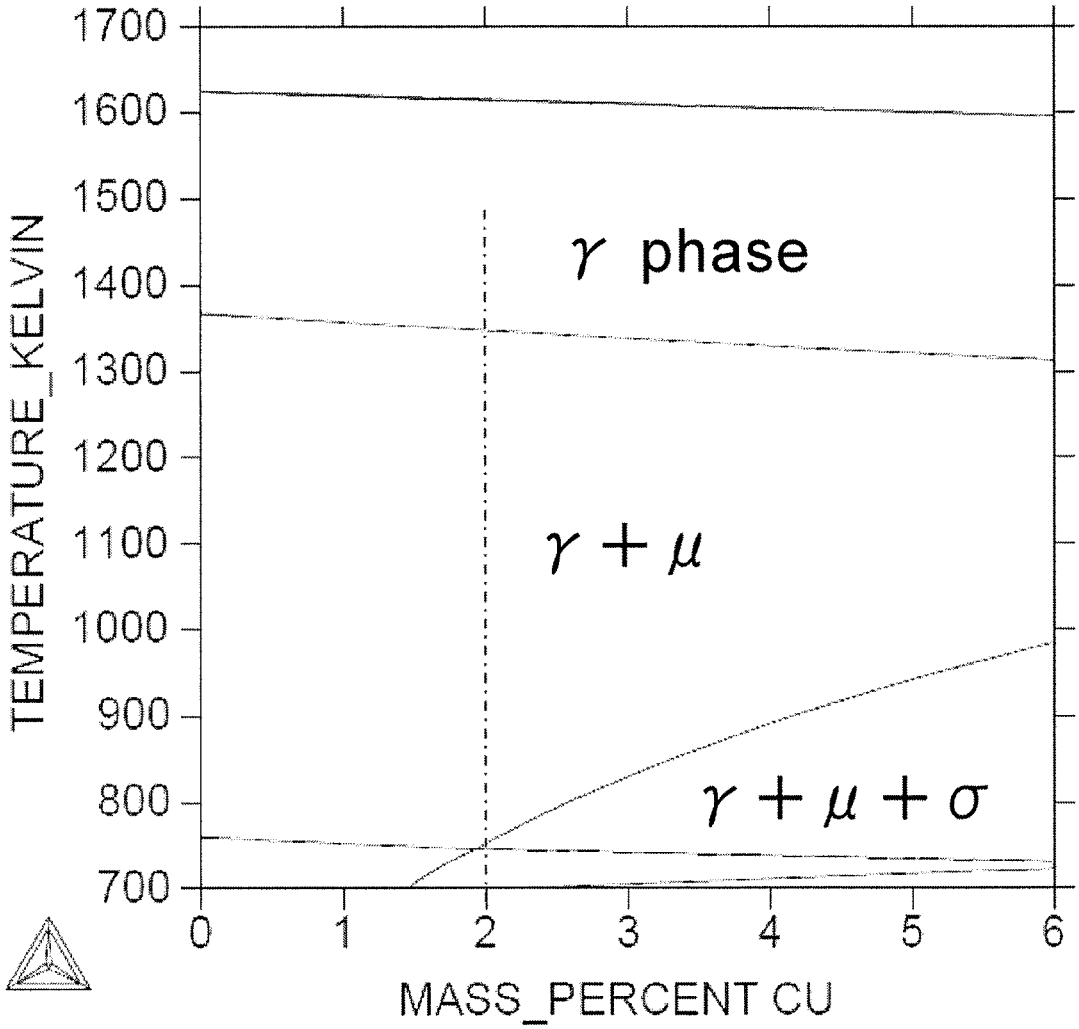
FIG. 1 is a phase diagram of a Ni-30Co-16Cr-15Mo-6Fe-xCu (wt %) alloy relating to an embodiment of the present invention.

The reasons for limiting the composition ranges of each component of the Ni-based alloy of the present invention are as described below.

[Co: 0% by Weight to 30% by Weight]

Co is preferably added at 15% by weight to 30% by weight in terms of the added amount thereof since it demonstrates the effect of improving wear resistance properties by increasing strength. However, the Ni-based alloy of the present invention can also be provided for practical use without adding Co in the case of applications not requiring any particular consideration of wear resistance properties, and in consideration thereof, the added amount of Co is 0% by weight to 30% by weight. If the added amount exceeds 30% by weight, the μ phase precipitates easily as described in Non-Patent Document 1, thereby resulting in poor corrosion resistance. In addition, since the cost of the alloy also increases, the upper limit of the added amount of Co is set to 30% by weight.

[Cr: 15.5% by Weight to 16.5% by Weight]

Cr is added at 15.5% by weight to 16.5% by weight in order to ensure corrosion resistance of the alloy in an oxidizing atmosphere by putting Cr into a solid solution. Since a dense $Cr_2O_3$ oxide film cannot be formed in an oxidizing atmosphere if the added amount of Cr is less than 15.5% by weight, 15.5% is set for the lower limit of the added amount thereof. Since hardness and mechanical properties of the alloy decrease if the added amount exceeds 16.5%, 16.5% is set for the upper limit of the added amount thereof.

[Mo: 7.5% by Weight to 15.5% by Weight]

The amount of Mo was set to 7.5% by weight to 15.5% by weight so as to be able to form a passive film in which Mo and Cu are present in a hydrofluoric acid atmosphere in the case of having added Cu at 0.5% by weight to 4.0% by weight. Since a dense passive film cannot be formed in a non-oxidizing atmosphere (hydrofluoric acid) if the added amount of Mo is less than 7.5% by weight, 7.5% by weight was set for the lower limit. Since a Mo-rich μ phase precipitates easily, the surface composition of the alloy becomes heterogeneous and corrosion resistance to hydrofluoric acid decreases if the added amount exceeds 15.5% by weight, 15.5% by weight was set for the upper limit.

[Fe: 4.5% by Weight to 15% by Weight]

Fe is effective for improving material processability. At least 4.5% by weight or more is required to be contained particularly when Co is present. In addition, since Fe is less expensive than Ni and Co, the addition of Fe also has the effect of reducing material costs. However, the addition of Fe in excess of 17% by weight results in precipitation of a brittle a phase in the matrix phase, which has the effect of lowering alloy processability and plasticity. In this manner, since a brittle a phase precipitates if Fe is added at 17% by weight to 18% by weight or more, the amount of iron is typically preferably 4.5% by weight to 15% by weight.

[Cu: 0.5% by Weight to 4.0% by Weight]

In the case of having added Cu at 0.5% by weight to 4.0% by weight, a passive film comprised of Cu can be formed instead of Mo in a hydrofluoric acid atmosphere, thereby having the effect of reducing the amount of Mo and lowering the precipitation temperature of the μ phase. In addition, in the case of having added Cu, an effect is also demonstrated that prevents a further decrease in alloy corrosion resistance following cold processing. If Cu is added at 4.0% by weight or more, precipitation of the sigma (a) phase is promoted resulting in poor corrosion resistance. In addition, since alloy processability also becomes poor if Cu is added at 4.0% by weight or more, the amount of Cu is typically preferably 0.5% by weight to 4.0% by weight.

Unavoidably included elements are elements having high processability that enter from raw materials during production or from a crucible during casting, and consist of carbon at 0.05% or less, Mn at 0.5% or less, Al at 0.5% or less and Si at 0.5% or less.

FIG. 1 is a phase diagram of a Ni-30Co-16Cr-15Mo-6Fe alloy to which Cu was added at 0% by weight to 6% by weight as calculated based on the Ni-based alloy thermodynamic database (Ni7 Database) using ThermoCalc5 (TCWS) software available from Thermo-Calc Software (Sweden). According to FIG. 1, the precipitation temperature of the μ phase was 1370 K (about 1100° C.) or lower as a result of adding Cu at 0% by weight to 6% by weight, and was determined to lower somewhat due to the addition of Cu.

Table 1 indicates the Vickers hardness for each alloy in the table following completion of each treatment when having undergone homogenization treatment for 24 hours at 1250° C. and cold casting at a processing rate of 30% or 60% followed by aging treatment for 1 hour at 600° C. As shown in Table 1, the hardness of all of the materials clearly increases when subjected to cold processing. In addition, material hardness is able to be further increased by carrying out aging treatment after subjecting to cold processing. The hardness of alloys in which Ni was substituted with Co was much higher than the hardness of alloys not containing Co following cold processing and aging treatment. In addition, when the added amount of Co was increased from 0% by weight to 5% by weight, 10% by weight, 15% by weight or 30% by weight, although there was little change in hardness of the materials in the homogenized state, the hardness of the alloys following cold processing and aging treatment was determined to increase strongly dependent on the amount of Co.

TABLE 1

| | Homogenization treatment state | 30% cold processing | 30% cold processing + aging | 60% cold processing | 60% cold processing + aging |
|---|---|---|---|---|---|
| Ni16Cr15Mo6Fe4W | 201 | 323 | — | 432 | 483 |
| Ni5Co16Cr15Mo6Fe4W | 204 | 331 | — | 442 | 490 |
| Ni10Co16Cr15Mo6Fe4W | 198 | 345 | — | 438 | 510 |
| Ni15Co16Cr15Mo6Fe4W | 200 | 379 | — | 439 | 525 |
| Ni30Co16Cr15Mo6Fe | 220 | 385 | — | 451 | 582 |
| Ni30Co16Cr15Mo6Fe2Cu | 191 | 374 | 403 | 476 | 574 |
| Ni30Co16Cr15Mo15Fe2Cu | 178 | 353 | 412 | 472 | 580 |
| Ni30Co16Cr10Mo6Fe2Cu | 157 | 342 | 385 | 443 | 562 |
| Ni30Co16Cr10Mo6Fe | 165 | 150 | 392 | 446 | 571 |

Table 2 indicates weight loss rates (mg/cm$^2$) when the alloys in the table were subjected to each treatment followed by respectively immersing for 100 hours in hydrofluoric acid (5.2 M) at 100° C. As shown in Table 2, there were no effects observed on material corrosion resistance in the homogenization treatment state when the added amount of Co was increased from 0% by weight to 5% by weight, 10% by weight, 15% by weight or 30% by weight. In addition, corrosion resistance of Ni-16Cr-6Fe—Mo alloy not containing Co was determined to be superior even after cold processing. However, in the case of not adding Co, corrosion resistance of alloys to which Co had been added decreased rapidly following aging treatment for 1 hour at 600° C. In addition, corrosion resistance following cold processing clearly worsened accompanying increases in the amount of Co added. In contrast, corrosion resistance was determined to not decrease due to cold processing or aging treatment in the case of having added Cu at 2% by weight.

TABLE 2

| | Homogenization treatment state | 30% cold processing | 30% cold processing + aging | 60% cold processing | 60% cold processing + aging |
|---|---|---|---|---|---|
| Ni16Cr15Mo6Fe4W | 6.07 | 3.27 | — | 4.10 | 97.21 |
| Ni5Co16Cr15Mo6Fe4W | 6.21 | 7.85 | — | 10.21 | — |
| Ni10Co16Cr15Mo6Fe4W | 6.45 | 12.25 | — | 18.71 | — |
| Ni15Co16Cr15Mo6Fe4W | 7.02 | 22.5 | — | 27.8 | — |
| Ni30Co16Cr15Mo6Fe | 5.75 | 44.24 | — | 34.34 | 178.82 |
| Ni30Co16Cr15Mo6Fe2Cu | 0.90 | 2.05 | 0.84 | 0.62 | 1.52 |
| Ni30Co16Cr15Mo15Fe2Cu | 4.88 | 7.61 | 8.25 | 10.52 | 11.25 |
| Ni30Co16Cr10Mo6Fe2Cu | 0.81 | 1.45 | — | 1.22 | — |
| Ni30Co16Cr10Mo6Fe | 210 | 260 | — | 170 | — |

Tables 3 and 4 respectively indicate Vickers hardness of a Ni-30Co-16Cr-15Mo-6Fe-2Cu (wt %) alloy that underwent aging treatment for 1 hour at 300° C. to 700° C. after having been subjected to homogenization treatment followed by the absence of cold processing, cold processing at a processing rate of 30% or cold processing at a processing rate of 60%, and weight loss rate (mg/cm$^2$) when the alloy was immersed for 100 hours in hydrofluoric acid (5.2 M) at 100° C. following each treatment. As shown in Tables 3 and 4, cold processing and aging treatment were determined to demonstrate the effect of raising material hardness in the same manner as Tables 1 and 2. In addition, this alloy was determined to demonstrate superior corrosion resistance in comparison with a commercially available Ni-16Cr-15Mo-6Fe-4W alloy following cold processing and aging treatment.

TABLE 3

| | Initial | 300° C. | 400° C. | 500° C. | 600° C. | 700° C. |
|---|---|---|---|---|---|---|
| Homogenization treatment | 191 | 198 | 195 | 204 | 202 | 216 |
| 30% cold processing | 374 | 375 | 390 | 407 | 403 | 378 |
| 60% cold processing | 476 | 521 | 549 | 555 | 574 | 541 |

TABLE 4

| | Initial | 300° C. | 400° C. | 500° C. | 600° C. | 700° C. |
|---|---|---|---|---|---|---|
| Homogenization treatment | 0.93 | 1.42 | 3.00 | 2.91 | 2.38 | 0.65 |

TABLE 4-continued

| | Initial | 300° C. | 400° C. | 500° C. | 600° C. | 700° C. |
|---|---|---|---|---|---|---|
| 30% cold processing | 2.06 | 3.70 | 3.30 | 3.05 | 0.81 | 1.07 |
| 60% cold processing | 0.61 | 3.41 | 5.12 | 4.37 | 1.52 | 6.50 |

Figure 2:
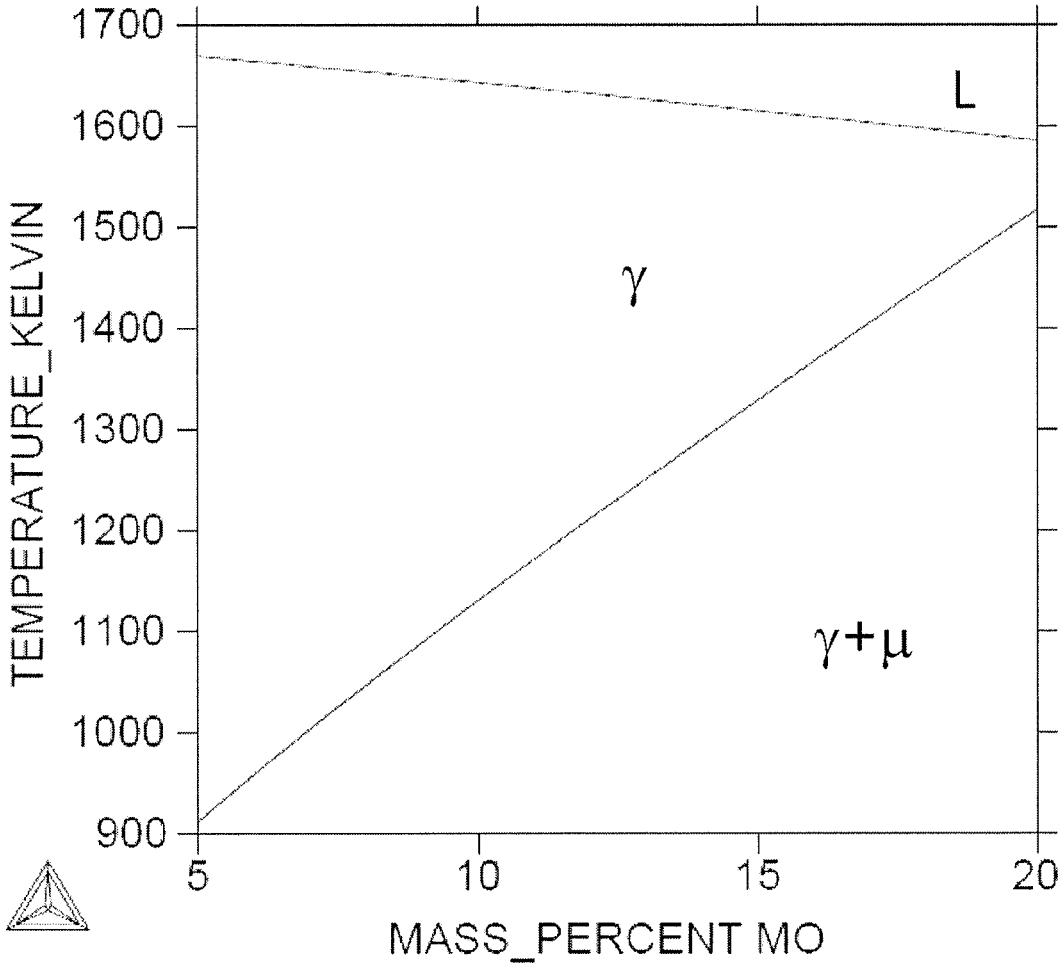
FIG. 2 is a phase diagram of a Ni-30Co-16Cr-6Fe-2Cu-xMo (wt %) alloy relating to an embodiment of the present invention.

FIG. 2 is a phase diagram of a Ni-30Co-16Cr-6Fe-2Cu-xMo (x=5% by weight to 20% by weight) alloy as calculated based on the Ni-based alloy thermodynamic database (Ni7 Database) using ThermoCalc5 (TCWS) software available from Thermo-Calc Software (Sweden). According to FIG. 2, the precipitation temperature of the μ phase was determined to lower rapidly when the amount of Mo decreased. For example, when the amount of Mo was decreased to 11% by weight, the precipitation temperature of the μ phase lowered to 1000° C. (1273 K) or lower, and a structure having dense crystal grains that does exhibit precipitation of the μ phase was obtained by carrying out hot casting at this temperature or higher.

Figure 3:
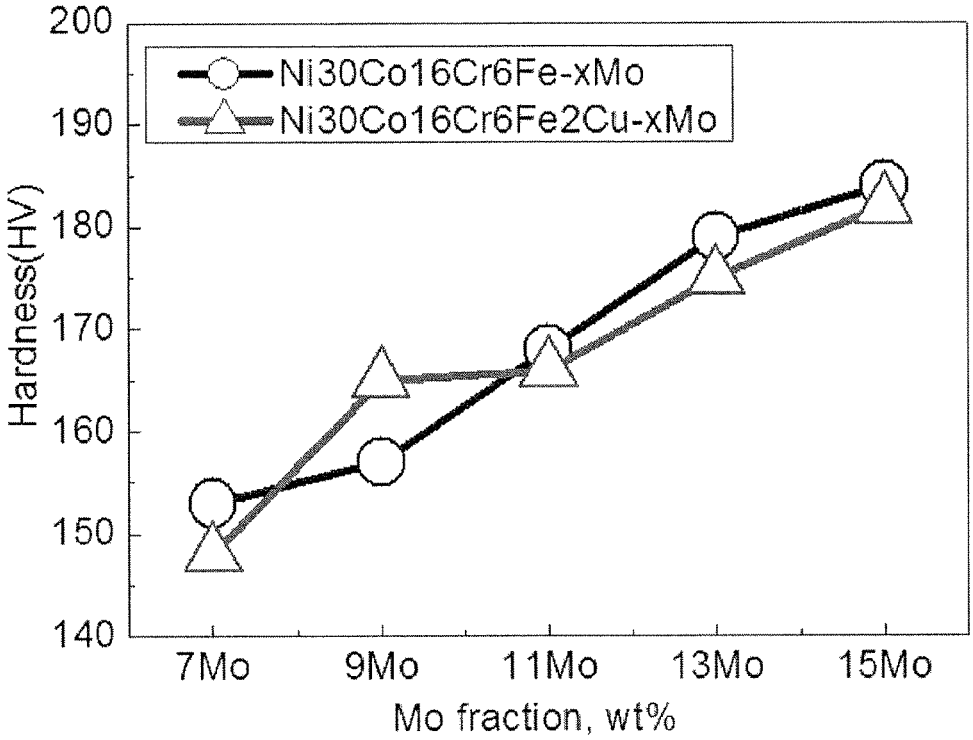
FIG. 3 is a graph indicating the Vickers hardness (hardness) of a Ni-30Co-16Cr-6Fe-xMo alloy and Ni-30Co-16Cr-6Fe-2Cu-xMo (x=7% by weight to 15% by weight) alloy relating an embodiment of the present invention when subjected to homogenization treatment for 24 hours at 1250° C.
Figure 4:
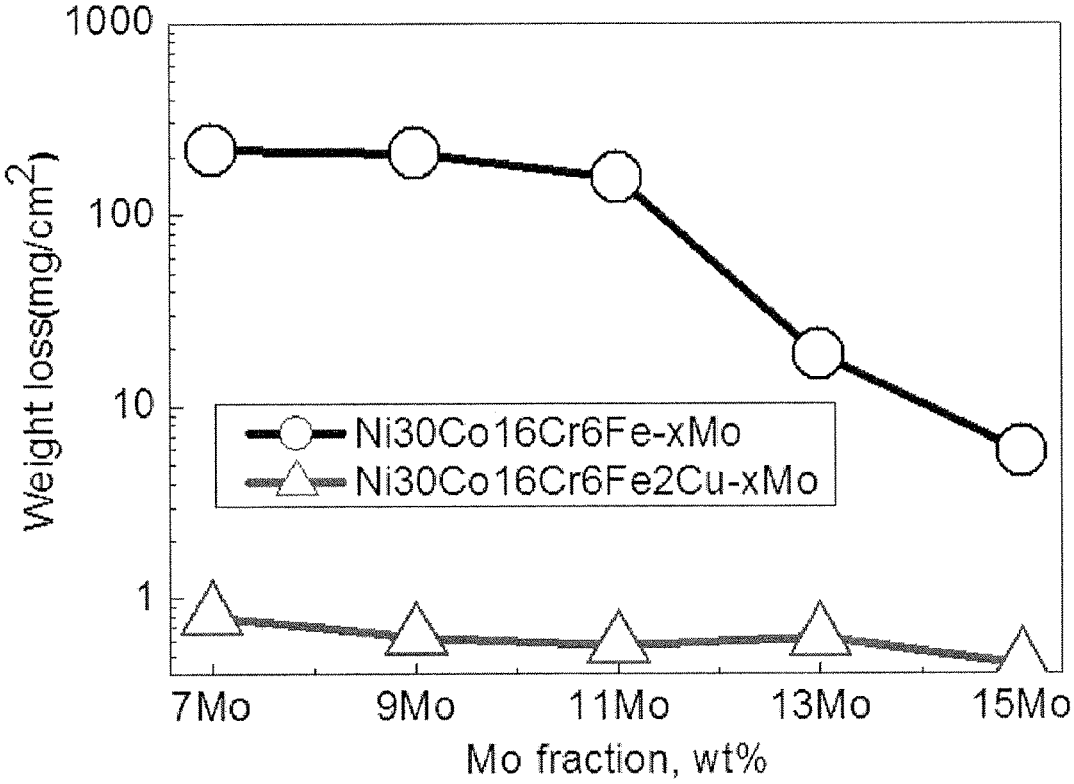
FIG. 4 is a graph indicating weight loss rates (weight loss) per unit area of a Ni-30Co-16Cr-6Fe-xMo alloy and Ni-30Co-16Cr-6Fe-2Cu-xMo (x=7% by weight to 15% by weight) relating to an embodiment of the present invention when subjected to homogenization treatment for 24 hours at 1250° C. followed by immersing for 100 hours in hydrofluoric acid (5.2 M) at 100° C.

FIG. 3 indicates Vickers hardness (hardness) when Ni-30Co-16Cr-6Fe-xMo alloy and a Ni-30Co-16Cr-6Fe-2Cu-xMo (x=7% by weight to 15% by weight) alloys were subjected to homogenization treatment for 24 hours at 1250° C. In addition, FIG. 4 indicates the weight loss rate (weight loss) when the alloys were immersed for 100 hours in hydrofluoric acid (5.2 M) at 100° C. following homogenization treatment. As indicated by FIGS. 3 and 4, the Vickers hardness of both types of alloys undergoes a small decrease when the amount of Mo is reduced. However, the Ni-30Co-16Cr-6Fe-xMo alloy not containing Cu demonstrated a large increase in weight loss rate following immersion caused by a decrease in the amount of Mo, and corrosion resistance worsened considerably. On the other hand, the Ni-30Co-16Cr-6Fe-2Cu-xMo alloy that contains Cu exhibited little change in weight loss rate following immersion caused by a decrease in the amount of Mo (1 $mg/cm^2$ or less in all cases), and corrosion resistance did not worsen despite a decrease in the amount of Mo.

INDUSTRIAL APPLICABILITY

The present invention is considered to have a high degree of industrial applicability as an alloy composition for use as a member such as a screw or cylinder for resin molding of fluorine-containing resins.

What is claimed is:

1. A method for producing a corrosion-resistant, high-hardness alloy composition, comprising: subjecting an ingot of an alloy, comprising 15.5% by weight to 16.5% by weight of Cr, 7.5% by weight to 15.5% by weight of Mo, 0% by weight to 30% by weight of Co, 4.5% by weight to 15% by weight of Fe and 0.5% by weight to 4.0% by weight of Cu, with the remainder consisting of Ni and unavoidably included elements, to homogenization treatment for 4 hours to 24 hours at 1100° C. to 1300° C., followed by subjecting to cold processing at a compression rate of 30% to 60% and then to aging treatment for 0.5 hours to 3 hours over a temperature range of 300° C. to 600° C.

2. A corrosion-resistant, high-hardness alloy composition produced by the method for producing a corrosion-resistant, high-hardness alloy composition according to claim 1, comprising: 15.5% by weight to 16.5% by weight of Cr, 7.5% by weight to 15.5% by weight of Mo, 0% by weight to 30% by weight of Co, 4.5% by weight to 15% by weight of Fe and 0.5% by weight to 4.0% by weight of Cu, with the remainder consisting of Ni and unavoidably included elements; wherein, the crystal phase consists only of a γ phase and the Vickers hardness at room temperature is 500 HV or more.

* * * * *